United States Patent [19]

Greene et al.

[11] 4,216,286

[45] Aug. 5, 1980

[54] METHOD OF LAMINATING CLOTH WITH PHOTOGRAPHIC EMULSION

[76] Inventors: J. Jerrold Greene, 4094 Inverrary Dr., Lauderhill, Fla. 33319; Avrom Keller, The Tennis Club, Fourth Ave., Ft. Lauderdale, Fla. 33339

[21] Appl. No.: 940,196

[22] Filed: Sep. 7, 1978

[51] Int. Cl.[2] ..... B44C 0/00

[52] U.S. Cl. ..... 430/203; 430/9; 430/11; 430/229; 430/256; 156/230; 156/235; 156/236; 156/240; 156/249; 156/288; 427/149; 430/199

[58] Field of Search ..... 96/50 PL, 83, 119 R, 96/15, 46, 48; 156/249, 235, 236, 230, 240, 288; 427/149

[56] References Cited

U.S. PATENT DOCUMENTS

| | | | |
|---|---|---|---|
| 196,510 | 10/1877 | Winters | 96/66 R |
| 1,582,136 | 4/1926 | Gustin et al. | 156/236 |
| 2,327,304 | 8/1943 | Grant | 96/15 |
| 2,372,994 | 4/1945 | Welch | 156/249 |
| 2,409,564 | 10/1946 | Heinecke et al. | 96/83 |
| 2,489,987 | 11/1949 | Barnola | 156/235 |
| 2,528,395 | 10/1950 | Slifkin | 96/75 |
| 2,537,097 | 1/1951 | Slifkin | 96/75 |
| 2,567,067 | 9/1951 | Grupp et al. | 427/149 |
| 2,606,130 | 8/1952 | Alexewicz et al. | 96/15 |
| 3,334,003 | 8/1967 | Edwards | 156/249 |
| 3,344,012 | 9/1967 | Strom | 156/240 |
| 3,661,672 | 5/1972 | McQuade | 156/240 |
| 3,836,414 | 9/1974 | Staats | 156/249 |
| 3,867,227 | 2/1975 | Klapper | 156/249 |
| 4,006,048 | 2/1977 | Cannady et al. | 156/288 |
| 4,027,345 | 6/1977 | Fujisawa et al. | 156/240 |
| 4,066,802 | 1/1978 | Clemens | 156/240 |

*Primary Examiner*—Charles L. Bowers, Jr.

*Attorney, Agent, or Firm*—Clarence A. O'Brien; Harvey B. Jacobson

[57] ABSTRACT

Cloth, such as cotton, burlap, or canvas, has a photographic emulsion laminated thereto, along with an outer protective film. The composite laminate formed is permanent, and sufficiently firmly affixed to the cloth that the cloth is machine washable without substantial damage or alteration of the laminated image. The method of making the cloth laminated with photographic emulsion comprises applying the photographic emulsion face-down on a protective film, coating with adhesive and applying the cloth, drying the emulsion and cloth and pressing between plates, at least one of which is heated. By dipping the emulsion in a stripping solution prior to applying to the protective film, adherence and permanence of the laminate formed is substantially increased.

6 Claims, 5 Drawing Figures

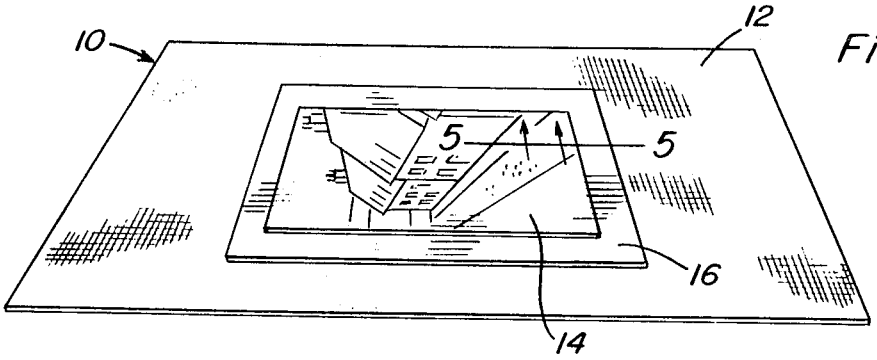
Fig. 1
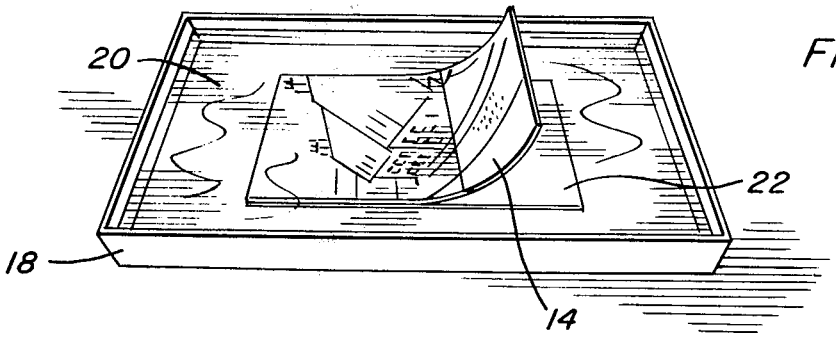
Fig. 2
Fig. 3
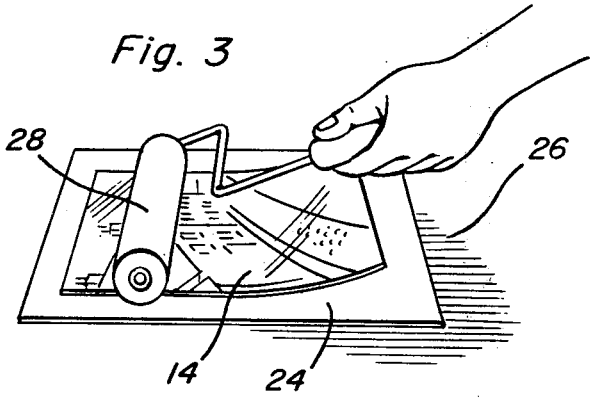
Fig. 5
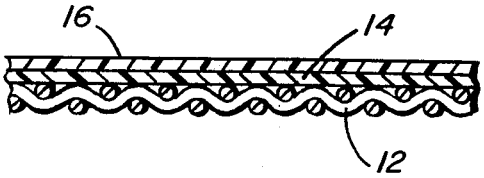
Fig. 4
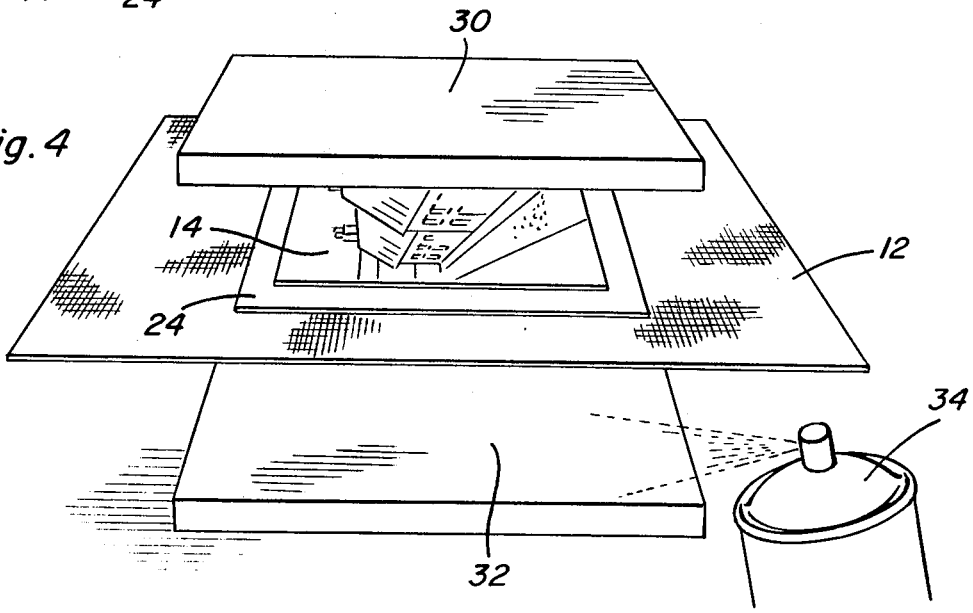

METHOD OF LAMINATING CLOTH WITH PHOTOGRAPHIC EMULSION

BACKGROUND OF THE INVENTION

1. Field of the Invention

The invention relates to cloth having an image of an actual color or black and white photograph laminated to its surface for decorative or other functional purpose, the cloth laminate being washable with no substantial alteration of the color or black and white image.

2. Description of the Prior Art

It is known in the prior art to prepare patterns typewritten on cloth with ribbon ink in response to typewriter commands generated by a computer responsive to the light intensity measured along various points of an image to be reproduced upon the cloth. This method is different from, and does not produce a product having the same fidelity of reproduction of, the present invention, which uses an actual photograph positive print as the basis for the laminate produced. When the photograph is a color positive print, the laminate produced will be in color, unlike such computer printouts, which ordinarily are restricted to a single color of printing ink, such as brown.

U.S. Pat. No. 2,537,097, issued to Slifkin, discloses a treatment of textile material with certain light sensitive compositions. Rick, in U.S. Pat. No. 2,756,434, teaches a pattern paper temporarily bonded to a textile material, where the pattern paper is removed from the textile material after certain sewing or embroidering operations are completed. The Miles Kimball, Fall 1975 Catalog, pages 158 and 193, shows a cotton and polyester shirt screened with a photograph, and a pillow having an enlarged reproduction of a photograph.

A drawback associated with prior art devices is failure to provide a laminate with sufficient permanence to withstand washing of the cloth with substantially no alteration of the photographic design. A further shortcoming of prior art processes is the time required in application of the various layers making up the laminate, increasing the cost and time required to produce the final article.

SUMMARY OF THE INVENTION

It is an object of the invention to provide a method for producing an article having a decorative design which faithfully reproduces an actual photograph, the article being machine washable without substantial alteration of the design.

Another object of the invention is to provide a cloth article laminated with a photographic emulsion which can be either a color photograph or a black and white photograph.

Still another object of the invention is to provide a cloth laminated with a photographic emulsion by a method which is rapid, simple, and inexpensive in actual operation.

Yet another object of the invention is to provide a laminate having a protective film intimately bonded and heat sealed to the photographic emulsion and the portions of the cloth immediately bordering the emulsion.

A further object of the invention is to provide a stripping solution for use in separating the photographic emulsion from its conventionally associated backing paper in a method for making a cloth article laminated with a photographic emulsion.

These and other objects are achieved by preparing a positive photographic print and placing in a tray containing warm water mixed with a proportion of certain types of hair shampoo. The photographic emulsion is stripped from the backing paper in the tray, and is applied facedown to a sheet of thin polyethylene. Excess moisture is removed and the emulsion smoothed out with a squeegee. Conventional water based adhesive is applied to the surface of the emulsion and a layer of suitable cloth is applied to the top surface coated with adhesive. The protective film, emulsion, and canvas are dried by heated forced air, and placed in a press having one heated plate against which the cloth surface is placed. After pressing at an appropriate pressure for a predetermined time, the pressed article is removed and a suitable coating, such as paint, varnish, or a gel can be optionally applied to the surface from which the emulsion image is visible.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a perspective view of a rectangular section of cloth having a photographic emulsion and a protective film laminated thereto according to the method of the present invention.

FIG. 2 is a perspective view of a tray containing a liquid solution for stripping the photographic emulsion from its backing film.

FIG. 3 is a perspective view of the step in the method of the present invention in which excess liquid from the stripping step is squeezed from the emulsion, and the emulsion is smoothed onto the protective film.

FIG. 4 is a perspective view of the press apparatus showing insertion of the cloth, emulsion and protective film, as well as spraying of the lower plate.

FIG. 5 is an enlarged fragmentary sectional view of the final laminate, taken substantially upon a plane passing along section line 5—5 on FIG. 1.

DESCRIPTION OF THE PREFERRED EMBODIMENT

The cloth laminate of the present invention produced according to the method of the present invention is designated in FIG. 1 generally by the numeral 10. Cloth 12 is in contact with photographic emulsion 14, and around the borders of emulsion 14, cloth 12 contacts protective film 16. Protective film 16 covers and protects emulsion 14 over its entire surface, as well as extending around the borders of emulsion 14. Photographic emulsion 14 can be derived from a color photographic print, or a black and white photographic print, and is prepared for lamination by stripping from the backing paper upon which positive photographic prints are ordinarily supplied. If, for example, an item is to be photographed for transposition as a laminate on cloth 12, the item is photographed on appropriate conventional photographic color or black and white film, as desired. The film is then developed in a conventional manner, and the negative produced thereby is used to produce an enlarged positive print in a conventional manner on a standard photographic paper, such as the photographic paper commercially available under the trademark "Kodak RC" paper. After conventional developing and before the conventional photographic print has dried, the print is placed in tray 18 containing an aqueous stripping solution 20. Solution 20 comprises a dilute solution of hair shampoo of the non-dyeing type, such as hair shampoo manufactured and commercially available under the trademark "Prell" or under the trademark "Balsam" at a concentration of about one to two fluid ounces per tray containing approximately 480 cubic inches of solution, or a concentration of about 0.38% to about 0.75% by volume. The solution is preferably formed from hair shampoos having a relatively low pH factor, being accordingly somewhat acid. A solution prepared as described and warmed somewhat above room temperature, for example, from about 85° F. to about 100° F, is placed in tray 18 and the positive photographic print immersed therein. Emulsion 14 can then be separated from backing paper 22 with minimum difficulty resulting from tearing of emulsion 14. Rejections due to tearing have been found to be reduced to an insignificant level by use of the solution described, while such rejections have been found to create substantial difficulty when warm water alone is used as the stripping solution. Moreover, when the solution of a composition described is used in place of warm water as the stripping solution, the permanence of the laminate ultimately obtained, as will be hereinafter described, is greatly enhanced, allowing machine washability without substantial alteration of or damage to the image on the laminate produced.

FIG. 2 shows emulsion 14 in the process of separation from backing paper 22, after which emulsion 14 is placed on a somewhat larger section of protective film 24, as shown in FIG. 3, with the surface of emulsion 14 opposite that in contact with backing paper 22 placed in contact with protective film 24. Protective film 24 is preferably a film of transparent synthetic resin, such as 0.5 mil (0.0005 inch) polyethylene, and the layers of emulsion 14 and film 24 are placed on a flat surface 26 for smoothing emulsion 14 with squeegee 28. Excess stripping solution is also removed as squeegee 28 smooths the emulsion 14 on film 24.

Emulsion 14 is coated with a conventional water based adhesive, such as a commercially available glue of any kind. Cloth 12 is placed over the emulsion coated with adhesive, and the emulsion and cloth to form a composite which is dried by heated forced air at a temperature of about 300° F. to 500° F.

The composite is placed in a press having an upper plate 30 and a bottom plate 32, which is heated to about 200° F. to 240° F. As shown in FIG. 4, bottom plate 32 is sprayed with a vegetable oil derivative, as represented by spray can 34. Emulsion 14 is sprayed with water, and cloth 12 is placed in contact with heated bottom plate 32 in the arrangement shown in FIG. 4. Plates 30 and 32 are brought together to apply a pressure of about 7,500 psi for a period of about 1 to 2 seconds.

Plates 30 and 32 are opened, and the pressed article is removed. A final surface coating can optionally be applied, such as paint varnish, particularly when cloth 12 is needlepoint canvas. When cloth 12 is burlap cloth, application of a gel gives an appearance after drying which makes final product 10 resemble an oil painting. When cloth 12 is cotton for producing an article of clothing, such as a T-shirt, no final coating or spraying is necessary. Such cotton laminated T-shirts are machine washable when prepared according to the method of the present invention, and the image represented by emulsion 14 and seen through protective film 24 remains substantially unchanged after such machine washing.

Although the laminated cloth produced according to the present invention has been described as useful for manufacture of an article of clothing, such as a T-shirt, many other articles as well can be produced, such as pillowcases, sport shirts, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Throughout the specification and claims, unless otherwise indicated, parts and proportions are given in volume percent, and temperatures in degrees Fahrenheit.

What is claimed as new is as follows:

1. A method of manufacturing an article comprising a composite of cloth laminated with a photographic emulsion comprising the following steps:

(a) photographing an item to be transposed onto said cloth laminate;

(b) developing said film to produce a negative and using conventional enlarging technique to produce a positive photographic enlarged print comprising an emulsion bonded to a backing paper;

(c) immersing said print in a stripping solution comprising a non-dyeing hair shampoo of low pH factor in an aqueous solution at a temperature of about 85° F. to about 100° F. and a concentration of shampoo of about 0.38% to about 0.75% by volume, whereby tearing of said emulsion is substantially preventable;

(d) stripping the emulsion from said backing paper;

(e) placing said emulsion on a sheet of protective film and smoothing said emulsion to remove excess stripping solution therefrom;

(f) coating said emulsion with a water based adhesive;

(g) placing said cloth on said coated emulsion to form a composite;

(h) drying said composite with heated forced air;

(i) placing said dried composite in press means whereby said cloth surface is exposed to an elevated press temperature;

(j) pressing with said press means comprising a heated bottom plate sprayed with a vegetable oil derivative for contacting said cloth surface of said dried composite and a receiving plate for contacting said protective film surface of said dried composite, wherein said bottom plate is heated to a temperature of about 200° F. to about 240° F., said bottom plate and said receiving plate pressing said composite at a pressure of about 7500 psi for a time of about 1 to about 2 seconds; and (k) removing said pressed composite from said press means, whereby permanence of the composite is obtained due to the temperature and composition of the stripping solution and whereby machine washing of the composite is possible without substantial alteration of or damage to the composite.

2. The method of claim 1 wherein said protective film is polyethylene having a thickness of about 0.0005 inch.

3. The method of claim 2 wherein said cloth is cotton and said article is a T-shirt formed from said pressed composite.

4. The method of claim 2 wherein said cloth is needle-point canvas and said pressed composite is sprayed with paint varnish to form said article.

5. The method of claim 2 wherein said cloth is burlap and said pressed composite is coated with gel and dried to form said article.

6. The method of claim 1 wherein said heated forced air is heated to a temperature of from about 300° F. to about 500° F.

* * * * *